US008918038B2

(12) United States Patent
Tsukioka

(10) Patent No.: US 8,918,038 B2
(45) Date of Patent: Dec. 23, 2014

(54) FIXING DEVICE AND IMAGE FORMING APPARATUS INCORPORATING SAME

(75) Inventor: Yasutada Tsukioka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 869 days.

(21) Appl. No.: 13/081,972

(22) Filed: Apr. 7, 2011

(65) Prior Publication Data

US 2011/0299895 A1 Dec. 8, 2011

(30) Foreign Application Priority Data

Jun. 4, 2010 (JP) ..... 2010-128535

(51) Int. Cl.
*G03G 15/20* (2006.01)
*G03G 15/00* (2006.01)

(52) U.S. Cl.
CPC ..... *G03G 15/2085* (2013.01); *G03G 15/6573* (2013.01); *G03G 2215/00675* (2013.01); *G03G 2215/00805* (2013.01); *G03G 2215/0081* (2013.01)
USPC ..... 399/322; 399/341

(58) Field of Classification Search
CPC ..... G03G 15/20; G03G 15/22; G03G 15/657; G03G 15/6573; G03G 15/2003; G03G 15/234; G03G 2215/00421; G03G 2215/00438; G03G 2215/007
See application file for complete search history.

(56) References Cited

U.S. PATENT DOCUMENTS 7,054,570 B2 5/2006 Kishi et al.
7,116,923 B2 10/2006 Kishi et al.
7,130,555 B2 10/2006 Kishi et al.
7,209,675 B2 4/2007 Matsusaka et al.
7,212,758 B2 5/2007 Kishi et al.
7,212,759 B2 5/2007 Kishi et al.
7,239,821 B2 7/2007 Matsusaka et al.

(Continued)

FOREIGN PATENT DOCUMENTS

JP 2884714 2/1999
JP 3584641 8/2004

(Continued)

OTHER PUBLICATIONS

Office Action issued Dec. 25, 2013 in Japanese Patent Application No. 2010-128535.

(Continued)

*Primary Examiner* — Clayton E Laballe
*Assistant Examiner* — Victor Verbitsky
(74) *Attorney, Agent, or Firm* — Oblon, Spivak, McClelland, Maier & Neustadt, L.L.P.

(57) ABSTRACT

A fixing device includes a fixing unit and a gloss equalizing unit. The fixing unit is disposed in a media conveyance path to fix a toner image on a recording medium conveyed therethrough. The fixing unit includes a rotary fuser member, a rotary pressure member, and a media stripper. The fuser member is subjected to heating. The rotary pressure member is pressed against the fuser member to form a fixing nip therebetween. The media stripper is held in contact with the pressure member to allow the recording medium to separate from the pressure member. The gloss equalizing unit is disposed downstream from the fixing unit along the media conveyance path. The gloss equalizing unit includes a pair of first and second rotary glossing rollers, at least one of which is heated and at least one of which is pressed against the other to form a gloss equalizing nip therebetween.

20 Claims, 5 Drawing Sheets

(56) References Cited

U.S. PATENT DOCUMENTS

| | | | | |
|---|---|---|---|---|
| 7,260,351 | B2 * | 8/2007 | Nakayama | 399/320 |
| 7,263,303 | B2 * | 8/2007 | Nakayama | 399/68 |
| 7,308,216 | B2 | 12/2007 | Kishi et al. | |
| 7,333,743 | B2 | 2/2008 | Kishi et al. | |
| 7,336,920 | B2 * | 2/2008 | Anderson et al. | 399/341 |
| 7,343,113 | B2 | 3/2008 | Matsusaka et al. | |
| 7,356,270 | B2 | 4/2008 | Matsusaka et al. | |
| 7,366,432 | B2 | 4/2008 | Kishi et al. | |
| 7,373,094 | B2 | 5/2008 | Kishi et al. | |
| 7,406,292 | B2 * | 7/2008 | Kamiyama | 399/406 |
| 7,496,309 | B2 | 2/2009 | Matsusaka et al. | |
| 7,515,845 | B2 | 4/2009 | Kishi et al. | |
| 7,551,869 | B2 | 6/2009 | Kishi et al. | |
| 7,565,087 | B2 | 7/2009 | Matsusaka et al. | |
| 7,603,049 | B2 | 10/2009 | Kishi et al. | |
| 7,609,988 | B2 | 10/2009 | Kishi et al. | |
| 7,664,410 | B2 | 2/2010 | Takagi | |
| 7,885,569 | B2 | 2/2011 | Kishi et al. | |
| 2005/0123315 | A1 | 6/2005 | Kishi et al. | |
| 2006/0051111 | A1 | 3/2006 | Kishi et al. | |
| 2006/0133836 | A1 | 6/2006 | Nakayama | 399/68 |
| 2007/0014600 | A1 | 1/2007 | Ishii et al. | |
| 2007/0031159 | A1 | 2/2007 | Kishi et al. | |
| 2007/0059024 | A1 * | 3/2007 | Kitayama | 399/92 |
| 2011/0058839 | A1 | 3/2011 | Tsukioka | |

FOREIGN PATENT DOCUMENTS

| | | | |
|---|---|---|---|
| JP | 3592485 | | 9/2004 |
| JP | 2004-325934 | A | 11/2004 |
| JP | 2004-361850 | | 12/2004 |
| JP | 2005-099136 | A | 4/2005 |
| JP | 2005-258263 | | 9/2005 |
| JP | 3716558 | | 9/2005 |
| JP | 2005-292568 | A | 10/2005 |
| JP | 2006-171220 | | 6/2006 |
| JP | 2006-327737 | | 12/2006 |
| JP | 2007-076750 | A | 3/2007 |
| JP | 2007-86128 | | 4/2007 |
| JP | 2010-107914 | A | 5/2010 |

OTHER PUBLICATIONS

Japanese Office Action dated Jun. 24, 2014 for Japanese Patent Application No. 2010-128535.

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2010-128535, filed on Jun. 4, 2010, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together forma heated area of contact called a fixing nip through which a recording medium is passed to fix a toner image onto the medium under heat and pressure.

One such fixing device includes a multi-roller, belt-based fuser assembly that employs an endless, flexible fuser belt entrained around multiple rollers, one of which is equipped with an internal heater to heat the length of the fuser belt through contact with the heated roller. The fuser belt is paired with a pressure roller pressed against the outer surface of the fuser belt to form a fixing nip therebetween, at which a toner image is fixed in place with heat from the fuser belt and pressure from the pressure roller.

Another type of fixing device includes a film-based fuser assembly that employs a fuser belt formed of thin heat-resistant film cylindrically looped around a stationary, ceramic heater. The fuser belt is paired with a pressure roller that rotates while pressing against the stationary heater through the fuser belt to form a fixing nip therebetween. At the fixing nip, the pressure roller rotates to advance the fuser belt together with an incoming recording sheet, while the stationary heater heats the recording sheet via the fuser belt, so that a toner image is fixed in place with heat from the stationary heater and pressure from the pressure roller.

Owing to the heat-resistant film which exhibits a relatively low heat capacity and therefore can be swiftly heated, the film-based fuser assembly eliminates the need for keeping the heater in a sufficiently heated state when idle, resulting in shorter start-up time and smaller amounts of energy wasted during standby, as well as a relatively compact size of the fuser assembly. With its high processing speed and good thermal efficiency, this type of fixing device finds application in on-demand, energy-efficient printers.

One important factor that determines imaging quality of a fixing device is the ability to properly convey a recording medium through the fixing nip without wrapping around the rotary fixing member, which would otherwise result in concomitant jam or other conveyance failure. For obtaining a fixing process with high immunity against media conveyance failure, most fixing devices employ a media stripping mechanism that allows a recording medium to properly separate from the rotary member upon exiting the fixing nip. Typical of such media stripper is an elongated plate having multiple fingers arranged in a longitudinal direction along the axial length of a rotary fixing member, with their finger tips touching the fixing member to strip off a recording medium adhering to the circumferential surface.

A problem encountered when employing a multi-fingered media stripper with a rotary fixing member, in particular, a rotary pressure member or roller, is variations in surface roughness of the fixing member caused during operation. That is, holding the stripper in direct contact with the rotating pressure roller causes scratches or gouges on those portions of the pressure roller where the finger tips rest on the moving surface of the pressure roller, while leaving the other portions substantially intact and smooth.

Such variations in surface roughness of the pressure member adversely affect quality of duplex printing through the fixing nip, where a recording medium, having its first side previously printed, undergoes a second pass to fix a toner image in place on its second side. As the recording medium enters the fixing nip, heat from the pressure member causes toner once set on the first printed side to slightly melt and soften to conform to the circumference of the pressure member, which makes the toner image appear rough and uneven in texture and gloss, as if copied from the roughened surface of the pressure member.

The problem is particularly pronounced where image formation is performed using toner that melts at a melting temperature significantly lower than those exhibited by standard types of toner. Toner with low melting point is developed to meet ever-growing demands for high-speed, energy-efficient printers, as it effectively reduces time and energy required to heat a fixing member to an operating temperature sufficient for fusing toner, resulting in short warm-up time for warming up the fixing assembly and short first-print time for receiving, executing, and completing an initial print job upon start-up.

To counteract the problem depicted above, one possible approach is to use a media stripper that can strip recording media without touching the pressure member. Unfortunately, however, this approach is impractical since using such a media stripper limits flexibility in optimizing certain operational properties of the fixing device, such as processing temperature, type of recording media, etc., which makes it difficult to provide a fixing process with high immunity against media conveyance failure.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a fixing unit and a gloss equalizing unit. The fixing unit is disposed in a media conveyance path to fix a toner image on a recording medium conveyed therethrough. The recording medium has a first side thereof printed firstly and a second side thereof printed subsequently during duplex printing. The fixing unit includes a rotary fuser member, a rotary pressure member, and a media stripper. The fuser member is subjected to heating. The rotary pressure member is pressed against the fuser member to form a fixing nip therebetween through which the recording medium is passed under heat and pressure along the media conveyance path as the fuser and pressure members rotate together. The media stripper is held in contact with the pressure member to allow the recording medium to separate from the pressure member upon exiting the fixing nip. The gloss equalizing unit is disposed downstream from the fixing unit along the media conveyance path to equalize gloss on the first side of the recording medium after printing on the second side. The gloss equalizing unit includes a pair of first and second rotary glossing rollers, at least one of which is heated and at least one of which is pressed against the other to forma gloss equalizing nip therebetween through which the recording medium is passed with the first printed side facing the first glossing roller, and the second printed side facing the second glossing roller, as the glossing rollers rotate together. The first glossing roller exhibits a surface roughness equal to or smaller than that of the pressure member of the fixing unit.

Other exemplary aspects of the present invention are put forward in view of the above-described circumstances, and provide a novel image forming apparatus.

BRIEF DESCRIPTION OF THE DRAWINGS

Amore complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
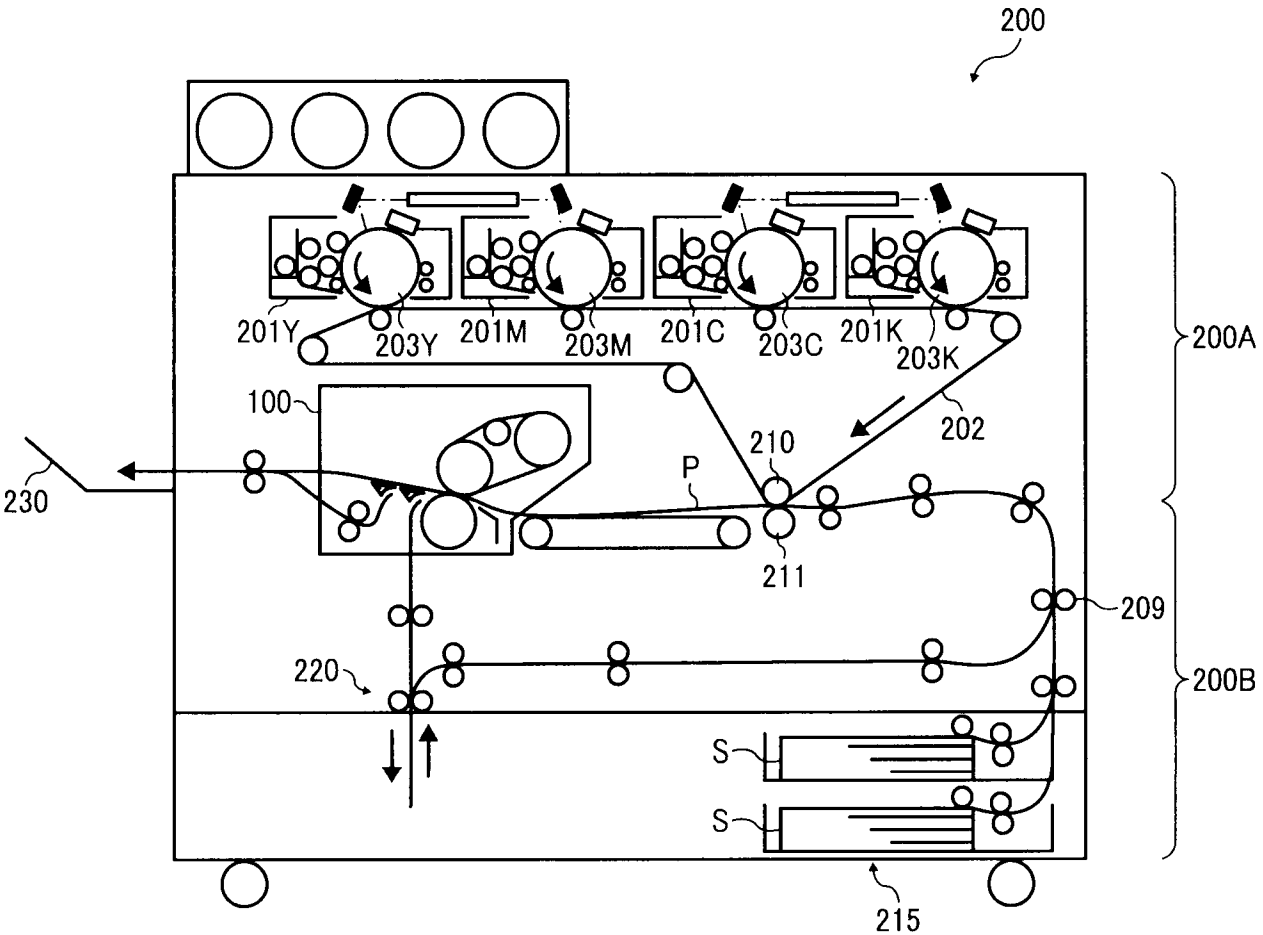
FIG. 1 schematically illustrates an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 200 incorporating a fixing device 100 according to one embodiment of this patent specification.

As shown in FIG. 1, the image forming apparatus 200 is a high-speed, digital color imaging system that can print a color image on a recording medium such as a sheet of paper S according to image data, consisting of an upper, printer section 200A, and a lower, sheet feeding section 200B combined together to form a freestanding unit, on top of which may be deployed an appropriate image scanner, not shown, that allows for capturing image data from an original document.

The printer section 200A comprises a tandem color printer that forms a color image by combining images of yellow, magenta, and cyan (i.e., the complements of three subtractive primary colors) as well as black, consisting of four electrophotographic imaging stations 201Y, 201M, 201C, and 201K arranged in series substantially laterally along the length of an intermediate transfer belt 202, each forming an image with toner particles of a particular primary color, as designated by the suffixes "Y" for yellow, "M" for magenta, "C" for cyan, and "K" for black.

Each imaging station 201 includes a drum-shaped photoconductor 203 rotatable counterclockwise in the drawing, surrounded by various pieces of imaging equipment, such as a charging device, a scanning device, a development device accommodating toner of the associated primary color, a primary transfer device incorporating an electrically biased, primary transfer roller, a cleaning device for the photoconductive surface, etc., which work in cooperation to form a primary toner image on the photoconductor 203 for subsequent transfer to the intermediate transfer belt 202 at a primary transfer nip defined between the photoconductive drum 203 and the primary transfer roller.

The intermediate transfer belt 202 is trained around a motor-driven roller and other support rollers to rotate clockwise in the drawing, passing through the four primary transfer nips sequentially to carry thereon a multi-color toner image toward a secondary transfer nip defined between a secondary transfer roller 211 and a backup roller 210, at which the toner image is transferred to a recording sheet S fed from the sheet feeding section 200B.

The sheet feeding section 200B includes one or more sheet trays 215 each accommodating a stock of recording sheets S, as well as a sheet conveyance mechanism, including multiple rollers, guide plates, etc., which together define a sheet conveyance path P for conveying a recording sheet S from the sheet tray 215, between a pair of registration rollers 209, then through the secondary transfer nip, and then through the fixing device 100. In the present embodiment, the sheet conveyance path P is substantially horizontal where it extends from the secondary transfer nip to the fixing device 100.

The fixing device 100 serves to fix the toner image in place on the recording sheet S with heat and pressure. The fixing device 100 connects with a sheet reversing unit 220 that reverses the recording sheet S after fixing to reintroduce it into the sheet conveyance path P where required, as well as with an output sheet stacker 230 disposed outside the apparatus body to accommodate a finalized print for user pickup.

A detailed description of the fixing device 100 and its associated structure will be given later with reference to FIG. 2 and subsequent drawings.

During operation, each imaging station 201 rotates the photoconductor drum 203 clockwise in the drawing to forward its outer, photoconductive surface to a series of electrophotographic processes, including charging, exposure, development, transfer, and cleaning, in one rotation of the photoconductor drum 203.

First, the photoconductive surface is uniformly charged by the charging device and subsequently exposed to a modulated laser beam emitted from the scanning device. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer device that electrostatically transfers the primary toner image to the intermediate transfer belt 202 through the primary transfer nip.

As the multiple imaging stations 201 sequentially produce toner images of different colors at the four transfer nips along the belt travel path, the primary toner images are superimposed one atop another to forma single multicolor image on the moving surface of the intermediate transfer belt 202 for subsequent entry to the secondary transfer nip between the secondary transfer roller 211 and the backup roller 210.

Meanwhile, the sheet conveyance mechanism picks up a recording sheet S from atop the sheet stack in the sheet tray 215 to introduce it between the pair of registration rollers 209 being rotated. Upon receiving the incoming sheet S, the registration rollers 209 stop rotation to hold the sheet S therebetween, and then advance it in sync with the movement of the intermediate transfer belt 202 to the secondary transfer nip.

At the secondary transfer nip, the multicolor image is transferred from the belt 202 to the recording sheet S, which is then introduced into the fixing device 100 to fix the toner image in place under heat and pressure. The recording sheet S, thus having its first side printed, may be forwarded directly to the sheet stacker 230 when simplex printing is intended, or to the sheet reversing unit 220 when duplex printing is intended.

For duplex printing, the sheet reversing unit 220 turns over the incoming sheet S for reentry to the sheet conveyance path P, wherein the reversed sheet S again undergoes electrophotographic imaging processes including registration through the registration roller pair 209, secondary transfer through the secondary transfer nip, and fixing through the fixing device 100 to form another print on its second side opposite the first side.

Upon completion of simplex or duplex printing, the recording sheet S is output to the sheet stacker 230 for stacking outside the apparatus body, which completes one operational cycle of the image forming apparatus 200.

Figure 2:
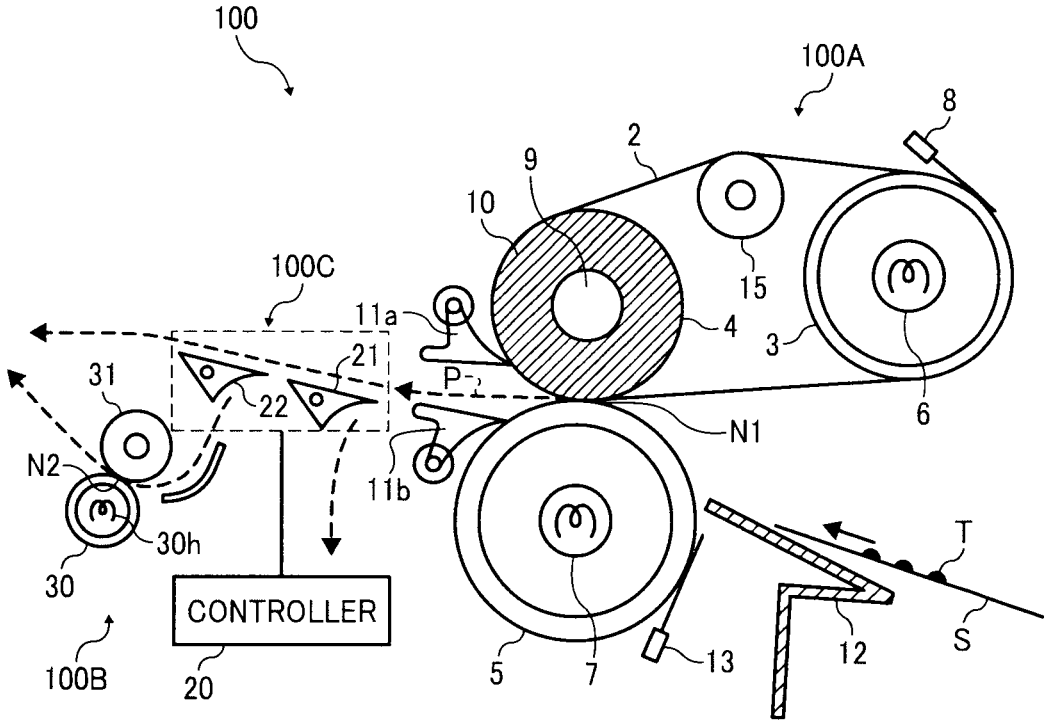
FIG. 2 is an end-on, axial cutaway view schematically illustrating the fixing device incorporated in the image forming apparatus according to this patent specification.

FIG. 2 is an end-on, axial cutaway view schematically illustrating the fixing device 100 incorporated in the image forming apparatus 200 according to this patent specification.

As shown in FIG. 2, the fixing device 100 includes a main, fixing unit 100A to fix a toner image T in place on a recording sheet S conveyed through the sheet conveyance path P; a gloss equalizing unit 100B disposed downstream from the fixing unit 100A along the sheet conveyance path P to equalize gloss on the first side of the recording sheet S after printing on the second side; and a sheet diverting unit 100C disposed between the fixing unit 100A and the gloss equalizing unit 100B to selectively direct the incoming sheet S to a particular destination depending on the type of processing the recording sheet S is subjected to.

Specifically, the fixing unit 100A includes a rotary fuser belt 2 entrained for rotation around a fixing roller 4, a heat roller 3, and a tension roller 15, as well as a rotary pressure roller 5 pressed against the fixing roller 4 through the fuser belt 2 to form a fixing nip N1 therebetween, all of which extend in an axial, longitudinal direction perpendicular to the sheet of paper on which the FIG. is drawn. A pair of first and second sheet strippers 11*a* and 11*b* are disposed opposed to each other, the former facing the fuser belt 2 and the latter facing the pressure roller 5, downstream from the fixing nip N1 along the sheet conveyance path P.

In the present embodiment, the fuser belt 2 comprises a rotatable endless belt formed of a substrate of stiff material upon which is deposited at least an outer layer of elastic material. For example, the fuser belt 2 may be a bi-layered belt consisting of a substrate of nickel, stainless steel, or polyimide, coated with an elastic layer of silicone rubber deposited thereupon.

The fixing roller 4 comprises a solid, motor-driven rotatable cylinder, consisting of a cylindrical core 9 of metal covered by an elastic layer 10 of silicone rubber or the like deposited thereupon, with a rotary motor connected to the metal core 9 to impart rotation to the cylindrical body. To obtain short warm-up time, sponged silicone rubber may be used to form the outer elastic layer 10, which does not absorb excessive heat to cause conductive heat loss where the roller 4 contacts the fuser belt 2.

The heat roller 3 comprises a hollow, rotatable cylinder of thermally conductive metal, such as iron or aluminum, which accommodates a radiant, halogen heater 6 or the like in its hollow interior to supply heat to the fuser assembly. Operation of the heater 6 is controlled according to readings of a thermometer or thermistor 8 disposed adjacent to the heat roller 3 to detect temperature of the fuser belt 2, so as to heat the belt 2 properly, for example, to a temperature suitable for fusing toner in use.

The pressure roller 5 comprises a cylindrical roller consisting of a hollow, rotatable core of metal, such as iron, aluminum, or the like, covered by an elastic layer of silicone rubber or the like deposited thereupon. Although not shown in the drawing, a biasing mechanism is provided to press the pressure roller 5 against the fixing roller 4 with a regulated constant pressure, so that the pressure roller 5 establishes sliding contact with the rotating fuser belt 2 at the fixing nip N1.

Optionally, the pressure roller 5 may have a dedicated internal heater 7 accommodated in its hollow interior, whose operation is controlled according to readings of a thermometer or thermistor 13 disposed adjacent to the pressure roller 5 to detect temperature of the roller surface, so as to heat the pressure roller 5 where required, for example, to a temperature desirable for heating the fixing nip N1 upon entry of a recording sheet S.

The first and second sheet strippers 11*a* and 11*b* each comprises an elongated, multi-fingered member provided with multiple fingers arranged in the axial direction. The finger tips of the first sheet stripper 11*a* adjoin the fuser belt 2 to allow a recording sheet S to separate from the belt surface at the exit of the fixing nip N1, whereas the finger tips of the second sheet stripper 11*b* are held in direct contact with the pressure roller 5 to allow a recording sheet S to separate from the roller surface at the exit of the fixing nip N1.

Although the present embodiment depicts the fuser assembly as an endless belt entrained around multiple rollers, alternatively, instead, the rotary fuser member may be configured as a hollow cylindrical roller or other suitable rotatable member. Further, although the present embodiment depicts a motor-driven fixing roller to drive the rotary members, alternatively a rotary motor may be provided to a pressure roller, a heat roller, or other suitable portion of the fixing assembly.

During operation, the fixing roller 4 rotates in a given direction of rotation (i.e., clockwise in FIG. 2) to rotate the fuser belt 2 in the same rotational direction, which in turn rotates the pressure roller 5 held in sliding contact with the rotating belt 2. The fuser belt 2 during rotation is kept in proper tension with the tension roller 15 pressing against the belt 2 from inside of the belt loop, while having its circumference heated with the heat roller 3 to a given processing temperature sufficient for fusing toner at the fixing nip N1.

In this state, a recording sheet S bearing an unfixed, powder toner image T enters the fixing unit 100A along a guide member 12, with its previously imaged side facing the fuser belt 2 and opposite side brought into contact with the pressure roller 5. As the rotary fixing members 2 and 5 rotate together, the recording sheet S is passed through the fixing nip N1 to fix the toner image in place, wherein heat from the fuser belt 2 causes toner particles to fuse and melt, while pressure from the pressure roller 5 causes the molten toner to settle onto the sheet surface.

At the exit of the fixing nip N1, the sheet strippers 11*a* and 11*b*, with their finger tips engageable with the leading edge of the outgoing sheet S, serve to strip the sheet S off the associated rotary members. In general, a recording sheet having a toner image fixed thereupon tends to adhere and wrap around the rotary fixing members as it exits the fixing nip. If not corrected, such tendency to wrap around would result in sheet jam or other malfunctioning of the sheet conveyance mechanism. The fixing unit 100A according to this patent specification is exempted from sheet conveyance failure, insofar as provision of the sheet strippers 11*a* and 11*b* effectively prevents the recording sheet S from wraparound and concomitant defects upon exiting the fixing nip N1. The recording sheet S thus properly passing through the fixing nip N1 proceeds to the sheet diverting unit 100C along the sheet conveyance path P.

As used herein, the term "path" or "sheet conveyance path" refers to a direction or imaginary plane in which the recording medium or sheet S proceeds from the input unit to an intended destination while guided by various pieces of the sheet conveyance mechanism as indicated by arrows P in the drawings. In particular, immediately downstream from the fixing nip N1, the sheet conveyance path represents a substantially straight direction or imaginary plane defined by the opposed sheet strippers 11*a* and 11*b* along which the recording sheet S enters the sheet diverting unit 100C upon exiting the fixing unit 100A.

Also, the term "first side" or "first printed side" herein refers to the front side of a recording sheet S, which is subjected to printing firstly during duplex process (or selectively during simplex process), whereas the term "second side" or "second printed side" refers to the back side opposite the front side of a recording sheet S, which is subjected to printing subsequent to printing of the first side during duplex process.

With continued reference to FIG. 2, the sheet diverting unit 100C is shown consisting of a pair of first and second, pivotable guide plates 21 and 22 arranged in series along the sheet conveyance path P, the former closer than the latter to the fixing unit 100A, which together form a switchable guide mechanism to direct the recording sheet S to a specific destination downstream from the original sheet conveyance path P. A controller 20, such as a central processing unit (CPU) and its associated memory devices, is operatively connected to the guide mechanism to control switching thereof, for example, by activating a solenoid or other suitable actuator provided to each guide plate.

Figure 3A:
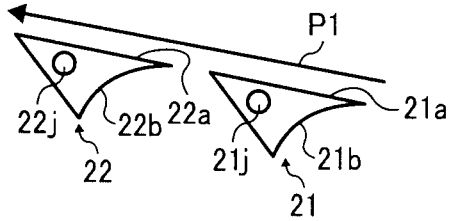
FIGS. 3A through 3C are enlarged schematic diagrams illustrating in detail a switchable guide mechanism of a sheet diverting unit included in the fixing device of FIG. 2.
Figure 3B:
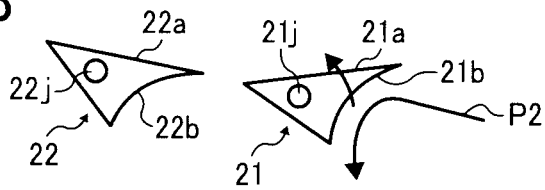
Figure 3C:
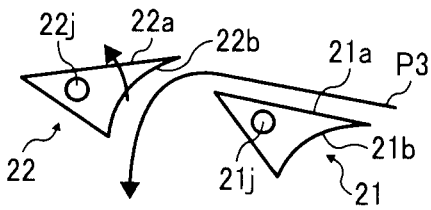

FIGS. 3A through 3C are enlarged schematic diagrams illustrating in detail the switchable guide mechanism of the sheet diverting unit 100C included in the fixing device 100 of FIG. 2.

As shown in FIGS. 3A through 3C, the first and second guide plates 21 and 22 each comprises a pivotable elongated member extending in the axial direction, the length of which is dimensioned according to the width of recording sheet S accommodated through the sheet conveyance path P.

The first guide plate 21 has a substantially planar guide surface 21*a* and an inwardly curved guide surface 21*b*, disposed adjacent to each other to together forma claw-like structure that pivots around a solenoid-actuated shaft 21*j*. Similarly, the second guide plate 22 has a substantially planar guide surface 22*a* and an inwardly curved guide surface 22*b*, disposed adjacent to each other to together forma claw-like structure that pivots around a solenoid-actuated shaft 22*j*.

During operation, the sheet diverting controller 20 activates the respective solenoid actuators to switch each pivotable guide plate between a first operational position, in which the planar guide surface lies substantially parallel to the sheet conveyance path P, and a second operational position, in which the planar guide surface is angled obliquely away from the sheet conveyance path P. This switching control is carried out depending on whether the recording sheet S is subjected to simplex process or duplex process, and whether the recording sheet S has its one side printed or both sides printed, so as to establish an appropriate post-fixing guide path downstream from the fixing nip N1 to convey the recording sheet S to an intended destination.

Specifically, the controller 20 may cause the first and second guide plates 21 and 22 each to retain the first operational position, so as to establish a first guide path P1 along the planar guide surfaces 21*a* and 22*a*, as shown in FIG. 3A. The first guide path P1 thus defined is substantially parallel to, or in alignment with, the sheet conveyance path P defined by the sheet strippers 11*a* and 11*b* downstream from the fixing nip N1, along which the recording sheet S is guided toward the output unit or stacker 230 with its leading edge substantially parallel to the straight, original conveyance path P.

The first guide path P1 is employed where the recording sheet S is destined for direct output from the fixing device 100 after simplex printing, that is, where the recording sheet S has its first side previously printed and does not require further printing on its second side as it exits the fixing unit 100A. Routing through the first path P1 thus allows the conveyed sheet S to immediately reach the output unit without making an unnecessary detour, which would otherwise risk damage to the printed face or add to the time required to complete a print job.

Further, the controller 20 may cause the first guide plate 21 to turn to the second operational position, and the second guide plate 22 to retain the first operational position, so as to establish a second guide path P2 along the inwardly curved guide surface 21*b*, as shown in FIG. 3B. The second guide path P2 thus defined deviates from the sheet conveyance path P defined by the sheet strippers 11*a* and 11*b* downstream from the fixing nip N1, along which the recording sheet S is guided toward the sheet reversing unit 220 with its leading edge deflected away from the straight, original conveyance path P.

The second guide path P2 is employed where the recording sheet S is destined for the sheet reversing unit 220 for reversing upside down during duplex printing, that is, where the recording sheet S has its first side previously printed and requires further printing on its second side as it exits the fixing unit 100A. Routing through the second path P2 allows the conveyed sheet S to properly enter the sheet reversing unit 220, which then re-enters the sheet conveyance path P with its first side down and second side up to undergo a second pass through electrophotographic imaging processes.

Furthermore, the controller 20 may cause the first guide plate 21 to retain the first operational position, and the second guide plate 22 to turn to the second operational position, so as to establish a third guide path P3 along the planar guide surface 21*a* and the curved guide surface 22*b*, as shown in FIG. 3C. The third guide path P3 thus defined deviates from the sheet conveyance path P defined by the sheet strippers 11*a* and 11*b* downstream from the fixing nip N1, along which the recording sheet S is guided toward the gloss equalizing unit 100B with its leading edge deflected away from the straight, original conveyance path P.

The third guide path P3 is employed where the recording sheet S is destined for the gloss equalizing unit 100B after duplex printing, that is, where the recording sheet S has both sides previously printed as it exits the fixing unit 100A. Routing through the third path P3 allows the sheet S to properly enter the gloss equalizing unit 100B, which equalizes gloss on the first side of the incoming sheet S after printing on the second side.

Referring back to FIG. 2, the gloss equalizing unit 100B is shown consisting of a first rotary glossing roller 30 and a second rotary glossing roller 31, at least one of which is heated and at least one of which is pressed against the other, to form a gloss equalizing nip N2 therebetween through which a recording sheet S after duplex printing is passed as the glossing rollers 30 and 31 rotate together, with its first printed side facing the first glossing roller 30 and second printed side facing the second glossing roller 31.

Figure 4:
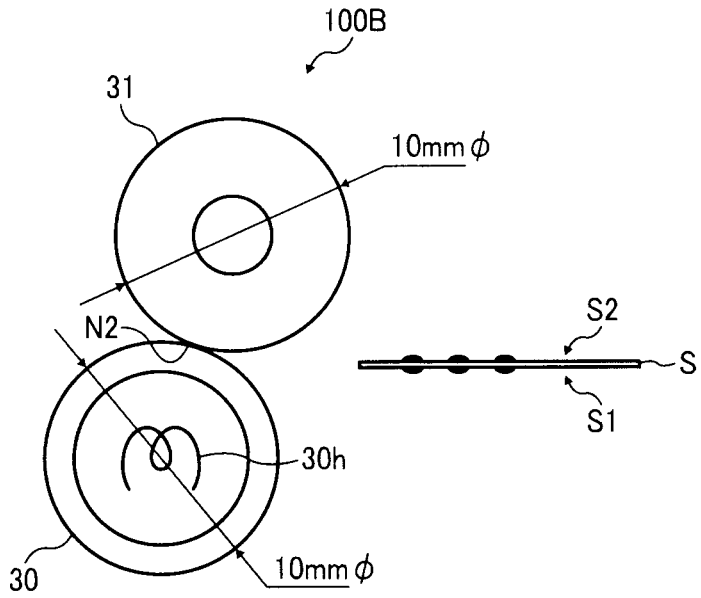
FIG. 4 is an enlarged, end-on axial view schematically illustrating one embodiment of a gloss equalizing unit included in the fixing device of FIG. 2.

FIG. 4 is an enlarged, end-on axial view schematically illustrating one embodiment of the gloss equalizing unit 100B included in the fixing device 100 of FIG. 2.

As shown in FIG. 4, the first glossing roller 30 comprises a rotatable cylindrical body, either solid or hollow, with an outer circumferential surface thereof subjected to heating by an appropriate heater 30*h*. In the present embodiment, the glossing roller 30 is formed of a hollow cylindrical core of aluminum covered by an outer layer of tetra fluoro ethylene-perfluoro alkylvinyl ether copolymer or perfluoroalkoxy (PFA) approximately 20 μm thick deposited thereupon, equipped with the heater 30*h* being an infrared or radiant heater such as a halogen heater disposed therein to heat the circumferential surface by radiation.

The second glossing roller 31 comprises a rotatable cylindrical body of metal, either solid or hollow, coated with an outer layer of elastic material, biasable by an appropriate biasing mechanism, not shown. In the present embodiment, the glossing roller 31 is formed of a solid cylindrical core of aluminum covered by an intermediate layer of silicone rubber approximately 50 μm, and an outer layer of PFA approximately 20 μm thick formed into a tubular configuration, deposited one upon another.

During operation, the first glossing roller 30 is heated by the heater 30*h* to a given glossing temperature determined, for example, depending on the type of toner in use, whereas the second roller 31 presses against the heated roller 30 with a regulated nip pressure. As the glossing rollers 30 and 31 rotate together, a duplex-printed recording sheet S passes through the gloss equalizing nip N2, with its first printed side S1 brought into contact with the first glossing roller 30 and its second printed side S2 with the second glossing roller 31. Upon exiting the gloss equalizing nip N2, the recording sheet S is forwarded to the sheet stacker 230 outside the fixing device 100.

According to this patent specification, the first glossing roller 30 has a substantially smooth circumferential surface, or more precisely, exhibits a surface roughness equal to or smaller than that of the pressure roller 5 of the fixing unit 100A. Such smoothness of the first glossing roller 30 equalizes gloss across the toner image printed on the first side S1 of the duplex-printed sheet S passed through the gloss equalizing nip N2, wherein toner once set on the first side S1 of the recording sheet S melts and softens with heat from the heated roller 30, and thus conforms to the smooth circumferential surface of the first glossing roller 30 under pressure from the second glossing roller 31, resulting in a smooth appearance of the toner image, uniform in texture and gloss as if copied from the smooth surface of the glossing roller 30.

Such gloss equalization effectively removes variations in gloss of a duplex-printed recording sheet S caused where the pressure roller 5 of the fixing unit 100A has its circumferential surface scratched or gouged as it rotates in direct contact with the multiple fingers of the sheet stripper 11*b*, which are typically disposed at intervals in the axial direction to form alternating areas of contact and non-contact with the circumferential surface of the rotating roller 5. Variations in surface roughness of the pressure member 5 translate into variations in gloss of the toner image on the first printed side, where heat from the pressure roller 5 causes toner once set on the first side of the recording sheet S to slightly melt and soften to conform to the circumference of the pressure roller 5, which makes the toner image appear rough and uneven in texture and gloss, as if copied from the roughened surface of the pressure roller 5.

The gloss equalizing capability of the fixing device 100 is particularly effective where image formation is performed using toner that melts at a temperature lower than a melting point exhibited by standard types of toner, which is most susceptible to variations in gloss of a resultant toner image due to variations in surface roughness of the pressure member at the fixing nip.

The glossing roller pair may be configured with any material, shaped and dimensioned as appropriate, and operated with any operating parameters, depending on the specific configuration of the fixing device, insofar as the first glossing roller 30 exhibits a surface roughness equal to or smaller than that of the pressure member of the fixing device. Optimized values for the configuration and operation of the gloss equalizing unit 100B may be obtained, for example, through experiments or simulations using specific types of toner and recording media and specific configurations of the fixing device.

Preferably, the first glossing roller 30 exhibits an Ra value (i.e., arithmetic average or center-line average surface roughness) of approximately 0.1 μm or below.

The appropriate range of surface roughness is deduced from experiments conducted to evaluate the effects of the gloss equalizing unit 100B according to this patent specification. Three specimens of duplex-printed material were prepared using a fixing device similar to that depicted in FIG. 2: Sample A output without gloss equalization after printing on the second side; Sample B subjected to gloss equalization after printing on the second side, wherein the gloss equalizing roller exhibits a surface roughness Ra of approximately 0.3 μm; and Sample C subjected to gloss equalization after printing on the second side, wherein the gloss equalizing roller exhibits a surface roughness Ra of approximately 0.1 μm.

In the experiments, gloss across the first printed side of each specimen was measured to determine a degree of gloss variation across the toner image thereon. In these and other experiments described in this patent specification, image gloss was measured using a 60-degree gloss meter that can measure gloss in % by directing a light across an image at an angle of 60°, with gloss variation calculated as a difference between maximum and minimum values of the image gloss measured unless otherwise specified. Values of gloss variation for the three specimens observed in the experiments are shown in FIG. 5.

Figure 5:
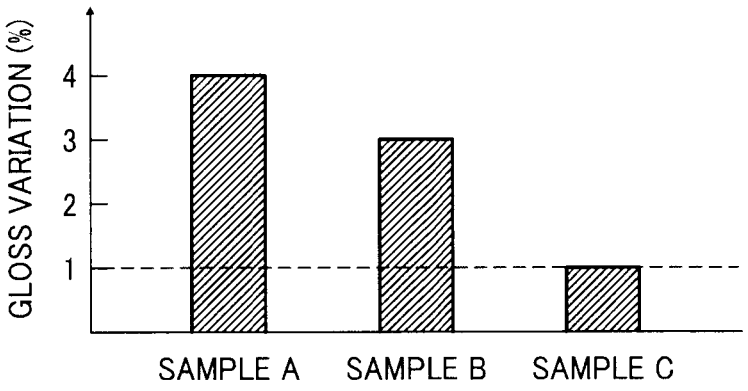
FIG. 5 is a graph showing experimental results evaluating efficacy of gloss equalization according to this patent specification.

As shown in FIG. 5, Samples B and C subjected to gloss equalization exhibited less significant gloss variation than Sample A output without gloss equalization, indicating that gloss equalization according to this patent specification can effectively mitigate variations in gloss across a toner image. In particular, Sample C processed using the 0.1-μm roughness glossing roller exhibited an extremely low gloss variation of 1%, which represents an acceptable level of gloss variation for high-quality, photographic applications.

More preferably, the first glossing roller 30 is heated, during operation, to a temperature equal to or greater than a melting temperature at which toner in use starts to soften or melt on the recording sheet S.

Figure 6:
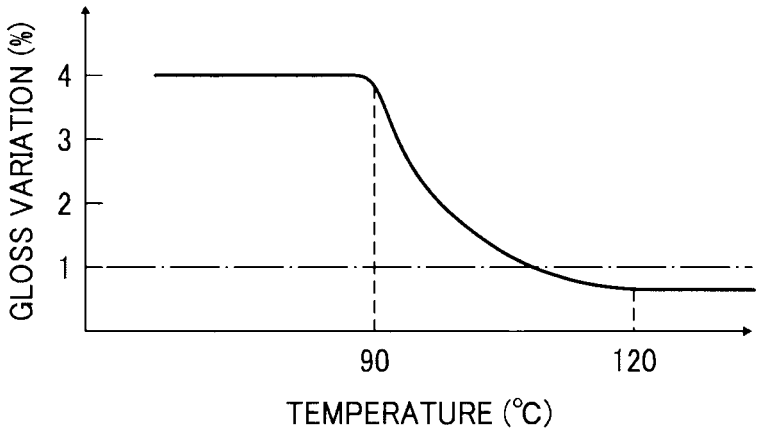
FIG. 6 is a graph showing a relation between temperature in degrees Celsius (° C.) of a gloss equalizing roller and gloss variation in % of image subjected to gloss equalization, obtained through experiments.

FIG. 6 shows a relation between temperature in degrees Celsius (° C.) of a gloss equalizing roller and gloss variation in % of image subjected to gloss equalization, obtained through experiments wherein gloss variation on the first printed side of duplex print subjected to gloss equalization at varying operating temperatures of the gloss equalizing roller was measured.

As shown in FIG. 6, the degree of gloss variation decreased as the roller temperature exceeded approximately 90° C., which is the melting point of toner used in the experiments. In particular, raising the roller temperature above approximately 120° C. resulted in an extremely low gloss variation of 1%, which represents an acceptable level of gloss variation for high-quality, photographic applications.

It is to be noted that, although specific values are presented in describing the experiments, the operating temperature of the first glossing roller 30 may be optimized depending on the type of toner in use which exhibits a particular melting temperature and other thermal properties.

More preferably still, the gloss equalizing rollers 30 and 31 both have a diameter of approximately 10 millimeters or smaller, so as to prevent sheet feeding failure caused where a recording sheet wraps around the glossing roller at the exit of the gloss equalizing nip due to adhesion of toner increased by heat from the heated glossing roller.

The appropriate range of roller diameter is deduced from experiments conducted to investigate effects of glossing roller diameter on sheet feeding performance, in which gloss equalization was performed on a duplex-printed recording sheet having a solid image printed on each side thereof, using three samples of gloss equalizing roller pair, each comprising a pair of equally sized, PFA-coated cylindrical rollers, one of which was heated to an operating temperature of approximately 120° C., prepared with three different roller diameters of 8 mm, 10 mm, and 12 mm, respectively.

In the experiments, each sample roller pair was tested for whether it caused the recording sheet to wrap around the glossing roller at the exit of the gloss equalizing nip. Results of the experiments are given in FIG. 7, showing a relation between glossing roller diameter in mm and susceptibility to sheet feeding failure, i.e., whether sheet wraparound was observed ("WRAPAROUND OBSERVED") or not ("NO WRAPAROUND").

Figure 7:
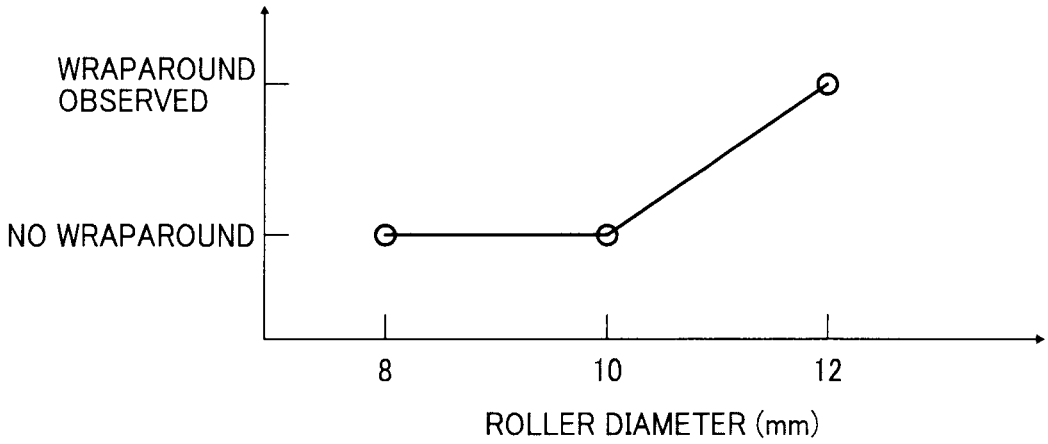
FIG. 7 is a graph showing a relation between glossing roller diameter in mm and susceptibility to sheet feeding failure, obtained through experiments.

As shown in FIG. 7, sheet wraparound was observed with the largest, 12-mm diameter roller, whereas the rollers with diameters 10 mm or less developed no such failure. The experimental results indicate that reducing the roller diameter to approximately 10 mm or smaller effectively prevents sheet feeding failure at the exit of the gloss equalizing nip, as it causes a corresponding increase in roller curvature that allows for ready separation of a recording sheet from the glossing rollers upon exiting the gloss equalizing nip.

Although particular embodiments of the gloss equalizing unit 100B are described above primarily with reference to FIG. 4, gloss equalization according to this patent specification may be accomplished otherwise than specifically disclosed herein. For example, the gloss equalizing unit 100B may employ any heating mechanism to heat the gloss equaling nip N2 with a suitable configuration of the glossing roller pair, as illustrated below with reference to FIGS. 8 and 9.

Figure 8:
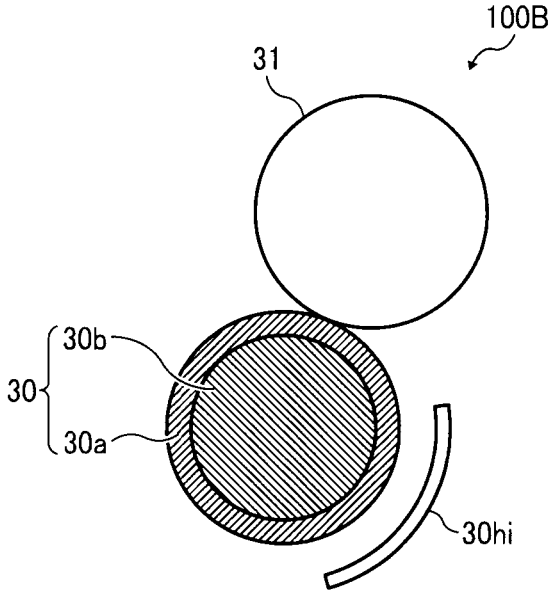
FIG. 8 is an enlarged, end-on axial view schematically illustrating a further embodiment of the gloss equalizing unit included in the fixing device of FIG. 2.

As shown in FIG. 8, the gloss equalizing unit 100B may employ an electromagnetic induction heater 30*hi*, instead of the radiant heater 30*h*, disposed adjacent to the first glossing roller 30 to heat the glossing roller 30 by electromagnetic induction. In such cases, the first glossing roller 30 may be configured as a solid cylinder consisting of a cylindrical metal core 30*b* coated with an outer layer of metal 30*a* deposited thereon subjected to electromagnetic induction to produce heat.

Figure 9:
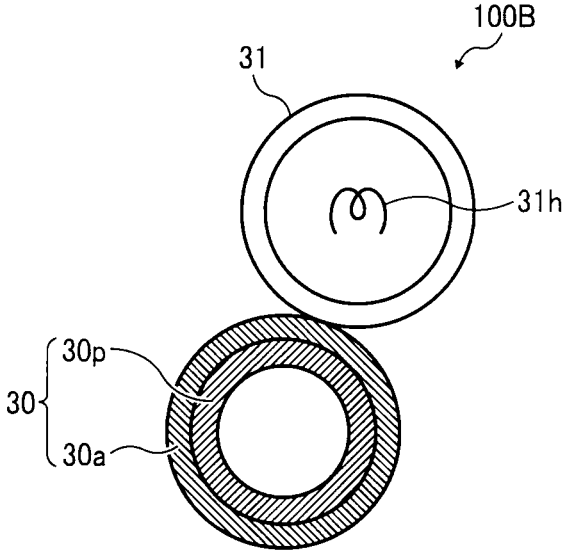
FIG. 9 is an enlarged, end-on axial view schematically illustrating a still further embodiment of the gloss equalizing unit included in the fixing device of FIG. 2.

Further, as shown in FIG. 9, the gloss equalizing unit 100B may employ a radiant, infrared heater 31*h* disposed in the second glossing roller 31, instead of the first glossing roller 30, to radiate heat to the second roller 31 for subsequent conduction to the first roller 30. In such cases, the first glossing roller 30 preferably includes a hollow, cylindrical heat pipe 30*p* of thermally conductive material covered by a suitable outer layer 30*a* deposited thereon, which allows for swift, uniform heating across the first glossing roller 30, resulting in reliable gloss equalization of the first printed side in the axial direction of the glossing roller.

Moreover, although particular embodiments of the sheet diverting unit 100C are described above primarily with reference to FIGS. 3A through 3C, media diverting mechanism according to this patent specification may be configured otherwise than specifically disclosed herein.

For example, instead of establishing the third guide path P3 separate from other guide paths, the third guide path P3 may coincide in space with the first guide path P1 where the gloss equalizing nip N2 is disposed along the first guide path P1, being openable and closable according to operation of the sheet diverting controller 20. In such cases, the controller 20 switches the guide mechanism to the first guide path P1 directly leading to the output unit by opening or removing the gloss equalizing nip N2, and to the third guide path P3 leading to the gloss equalizing nip N2 by closing or establishing the gloss equalizing nip N2, thereby allowing for secure, efficient conveyance of recording media during simplex and duplex processes.

Hence, the fixing device 100 according to this patent specification allows for duplex printing with a uniform gloss across a toner image printed on a first side of a recording medium S, owing to provision of the gloss equalizing unit 100B downstream from the fixing unit 100A along the media conveyance path P which equalizes gloss of the toner image by passing the duplex-printed recording medium S through the gloss equalizing nip N2 defined between the glossing rollers 30 and 31 downstream from the fixing nip N1 defined between the fuser and pressure members 2 and 5, wherein the first glossing roller 30, facing the first printed side of the recording medium S, exhibits a surface roughness equal to or smaller than that of the pressure member 5, so as to remove variations in gloss caused where the pressure member 5 has its circumferential surface roughened as it rotates indirect contact with the sheet stripper 11*b* during operation.

Moreover, provision of the media diverting unit 1000 between the fixing unit 100A and the gloss equalizing unit 100B along the media conveyance path P enables the fixing device 100 to convey a recording medium S to an intended destination securely and efficiently, which allows for proper execution of printing, either simplex or duplex, to yield a resulting image with uniform gloss on each printed side. The image forming apparatus 200 according to this patent specification benefits from these and other features of the fixing device 100 incorporated therein.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a fixing unit disposed in a media conveyance path to fix a toner image on a recording medium conveyed therethrough, the recording medium having a first side thereof printed firstly and a second side thereof printed subsequently during duplex printing, the fixing unit including:

a rotary fuser member subjected to heating;

a rotary pressure member pressed against the fuser member to form a fixing nip therebetween through which the recording medium is passed under heat and pressure along the media conveyance path as the fuser and pressure members rotate together; and a media stripper held in contact with the pressure member to allow the recording medium to separate from the pressure member upon exiting the fixing nip;

a gloss equalizing unit disposed downstream from the fixing unit along the media conveyance path to equalize gloss on the first side of the recording medium after printing on the second side; and a media diverting unit disposed between the fixing unit and the gloss equalizing unit, the media diverting unit including guide plates, wherein the guide plates of the media diverting unit include exactly two guide plates, wherein at least one of the guide plates is positionable to establish a guide path along an inwardly curved guide surface of the at least one of the guide plates, and wherein the guide plates of the media diverting unit are disposed to form three different conveyance paths.

2. The fixing device according to claim 1, wherein:

the media diverting unit selectively directs the recording medium to either one of first through third guide paths from the media conveyance path, the first guide path leading to an output unit that outputs the incoming medium outside the fixing device, the second guide path leading to a media inverting unit that inverts the incoming medium for reentry into the media conveyance path, the third guide path leading to the gloss equalizing unit for equalizing gloss on the first printed side of the incoming medium.

3. The fixing device according to claim 2, wherein the media diverting unit includes:

a switchable guide mechanism to selectively direct the recording medium to either one of the first through third guide paths from the media conveyance path; and a controller operatively connected to the guide mechanism to switch the guide mechanism to the first guide path where the recording medium has the first side thereof previously printed and does not require further printing on the second side thereof, to the second guide path where the recording medium has the first side thereof previously printed and requires further printing on the second side thereof, and to the third guide path where the recording medium has both sides thereof previously printed.

4. The fixing device according to claim 1, wherein the gloss equalizing unit includes:

a pair of first and second rotary glossing rollers, at least one of which is heated and at least one of which is pressed against the other to form a gloss equalizing nip therebetween through which the recording medium is passed with the first printed side facing the first glossing roller, and the second printed side facing the second glossing roller, as the glossing rollers rotate together, the first glossing roller exhibiting a surface roughness equal to or smaller than that of the pressure member of the fixing unit.

5. The fixing device according to claim 4, wherein the first glossing roller of the gloss equalizing unit exhibits a center-line average surface roughness of approximately 0.1 micrometer or smaller.

6. The fixing device according to claim 4, wherein the first glossing roller is heated to a temperature equal to or greater than that at which toner in use starts to soften or melt on the recording medium.

7. The fixing device according to claim 4, wherein the gloss equalizing unit includes an infrared heater to radiate heat to the glossing roller.

8. The fixing device according to claim 4, wherein the gloss equalizing unit includes an electromagnetic induction heater to heat the glossing roller by electromagnetic induction.

9. The fixing device according to claim 4, wherein the first glossing roller includes a hollow, cylindrical heat pipe of thermally conductive material to equalize heat in an axial direction thereof.

10. The fixing device according to claim 4, wherein the pair of first and second glossing rollers have a diameter of approximately 10 millimeters or smaller.

11. The fixing device according to claim 1, wherein the three different conveyance paths are (1) along flat surfaces of first and second ones of the guide plates; (2) along a curved surface of a first one of the guide plates; and (3) along a curved surface of a second one of the guide plates.

12. The fixing device according to claim 1, wherein the guide plates of the media diverting unit are disposed to form exactly three different conveyance paths.

13. The fixing device according to claim 12, wherein the three different conveyance paths are (1) along flat surfaces of first and second ones of the guide plates; (2) along a curved surface of a first one of the guide plates; and (3) along a curved surface of a second one of the guide plates.

14. The fixing device according to claim 1, wherein:

each of the guide plates includes a substantially planar guide surface.

15. An image forming apparatus comprising:

an electrophotographic imaging unit to form a toner image on a recording medium; and a fixing device to fix the toner image in place on the recording medium, the fixing device including:

a fixing unit disposed in a media conveyance path to fix a toner image on a recording medium conveyed therethrough, the recording medium having a first side thereof printed firstly and a second side thereof printed subsequently during duplex printing, the fixing unit including:

a rotary fuser member subjected to heating;

a rotary pressure member pressed against the fuser member to form a fixing nip therebetween through which the recording medium is passed under heat and pressure along the media conveyance path as the fuser and pressure members rotate together; and a media stripper held in contact with the pressure member to allow the recording medium to separate from the pressure member upon exiting the fixing nip; and a gloss equalizing unit disposed downstream from the fixing unit along the media conveyance path to equalize gloss on the first side of the recording medium after printing on the second side; and a media diverting unit disposed between the fixing unit and the gloss equalizing unit, the media diverting unit including guide plates, wherein the guide plates of the media diverting unit include exactly two guide plates, wherein at least one of the guide plates is positionable to establish a guide path along an inwardly curved guide surface of the at least one of the guide plates, and wherein the guide plates of the media diverting unit are disposed to form three different conveyance paths.

16. The image forming apparatus according to claim 15, wherein the gloss equalizing unit includes:

a pair of first and second rotary glossing rollers, at least one of which is heated and at least one of which is pressed against the other to form a gloss equalizing nip therebetween through which the recording medium is passed with the first printed side facing the first glossing roller, and the second printed side facing the second glossing roller, as the glossing rollers rotate together, the first glossing roller exhibiting a surface roughness equal to or smaller than that of the pressure member of the fixing unit.

17. The image forming apparatus according to claim 15, wherein the three different conveyance paths are (1) along flat surfaces of first and second ones of the guide plates; (2) along a curved surface of a first one of the guide plates; and (3) along a curved surface of a second one of the guide plates.

18. The image forming apparatus according to claim 15, wherein the guide plates of the media diverting unit are disposed to form exactly three different conveyance paths.

19. The image forming apparatus according to claim 18, wherein the three different conveyance paths are (1) along flat surfaces of first and second ones of the guide plates; (2) along a curved surface of a first one of the guide plates; and (3) along a curved surface of a second one of the guide plates.

20. The image forming apparatus according to claim 15, wherein:

each of the guide plates includes a substantially planar guide surface.

* * * * *